United States Patent [19]

Parsons et al.

[11] Patent Number: 4,919,877

[45] Date of Patent: Apr. 24, 1990

[54] PROCESS FOR SOFTENING WEBS

[75] Inventors: Mark N. Parsons; Rodney L. Abba, both of Neenah, Wis.

[73] Assignee: Kimberly-Clark Corporation, Neenah, Wis.

[21] Appl. No.: 404,916

[22] Filed: Sep. 8, 1989

Related U.S. Application Data

[63] Continuation-in-part of Ser. No. 111,473, Dec. 3, 1987, abandoned, which is a continuation of Ser. No. 908,498, Sep. 17, 1986, abandoned.

[51] Int. Cl.[5] ..... B31F 1/14

[52] U.S. Cl. ..... 264/282; 264/283; 162/280; 162/281; 156/183

[58] Field of Search ..... 162/280, 281; 264/282, 264/283; 156/183

[56] References Cited

U.S. PATENT DOCUMENTS

| | | | |
|---|---|---|---|
| 3,260,778 | 7/1966 | Walton | 264/282 |
| 3,507,745 | 4/1970 | Fuerst | 264/283 X |
| 3,810,280 | 5/1974 | Walton et al. | 264/282 X |
| 4,432,927 | 2/1984 | van Tilburg et al. | 264/282 |

*Primary Examiner*—Kenneth M. Schor
*Assistant Examiner*—Thi Dang
*Attorney, Agent, or Firm*—Gregory E. Croft

[57] ABSTRACT

A microcreping process is improved by using a razor sharp retarder blade positioned such that its razor edge is overlapped by either the primary blade or a back-up blade, whichever extends the furthest downstream. Preferably, pressure is applied to the primary blade through one or more back-up blades arranged in a step-wise configuration.

15 Claims, 2 Drawing Sheets

PROCESS FOR SOFTENING WEBS

This application is a continuation-in-part of copending application Ser. No. 07/111,473 filed on Dec. 3, 1987, now abandoned which is a continuation of application Ser. No. 06/908,498 filed on Sept. 17, 1986, now abandoned.

BACKGROUND OF THE INVENTION

In the manufacture of household paper products such as facial tissue, paper toweling, bath tissue and the like, continual efforts are directed toward improving the perceived softness of the product. In general softness is imparted to the paper web by creping, which serves to rupture fiber-to-fiber bonds within the web and thereby increase bulk and softness. One method of creping such webs, commonly referred to as "microcreping," is described in U.S. Pat. No. 3,260,778 issued July 12, 1966 to Richard R. Walton and entitled "Treatment of Materials." This patent, which is hereby incorporated by reference, describes a method in which the web is supported on the surface of a rotating drum and lengthwise compressed in a treatment cavity defined by the surfaces of the rotating drum, a primary blade which presses the web against the rotating drum, and an inclined rigid retarder blade which retards the forward movement of the web and dislodges the web from the surface of the rotating drum. The treatment cavity prevents the web from buckling beyond the dimensions of the treatment cavity, causing a lengthwise or machine direction compression of the web which results in softening.

However, heretofore a limiting factor of the microcreping process has been the speed in which the process can be operated. Speeds of 1500 feet per minute for a single ply web are generally considered the top speed. For high volume products such as tissues and toweling, this speed limitation has prevented significant commercial use of the process. Therefore there has been a need to improve the speed of the microcreping process without sacrificing the softness and strength of the product.

SUMMARY OF THE INVENTION

It has now been discovered that by using the process of this invention the speed of the microcreping process can be increased to greater than 3400 feet per minute for single-ply tissue products without loss in performance. In addition, heavy basis weight products, such as hand towels, can be made from low grade webs, such as newsprint, which exhibit unexpectedly good softness and drape due in part to the large number of crepe folds imparted to the product.

In one aspect, the invention resides in an improved microcreping process wherein the web is dislodged from the rotating drum with a retarder blade having a razor edge and an operating face angle in the range of 5° to 15°, the razor edge of the retarder blade being positioned directly below or overlapped by the end of the primary blade. Although pressure can be applied directly to the primary blade to maintain its position, pressure is preferably applied indirectly to the primary blade from a corner edge of a pressure plate through one or more back-up blades. If two or more back-up blades are used, the ends of the back-up blades are preferably offset from the end of the primary blade and each other in a stepwise configuration.

In another aspect, the invention resides in an improved microcreping process wherein the web is dislodged from the rotating drum with a retarder blade having a razor edge positioned directly below the portion of a backup blade which overlaps the end of a primary blade. It has been found that the treatment cavity of this aspect of this invention makes high speed possible without the need for low retarder blade operating face angles, although retarder blade operating face angles in the range of 5° to 15° are preferred.

In addition to producing soft products at higher speeds than previously attainable for making tissue, this process can produce high quality products from low quality furnishes, such as secondary fiber and groundwood. More specifically, acceptable hand towels can be made from webs made from newsprint or kraft furnishes having basis weights (in pounds per 3000 square feet) of from about 20 to about 55, preferably from about 25 to about 40, and most preferably from about 28 to about 33. Facial tissue, bath tissue, and kitchen toweling can be produced from one or more creped or uncreped cellulosic webs having a total basis weight of from about 8 to about 40 pounds per 3000 square feet. Accordingly, two or more webs can be simultaneously microcreped in the same treatment cavity using the method of this invention to produce a two-ply or multiple-ply tissue product.

These and other aspects of the invention will be more clearly described and understood by reference to the drawing.

DETAILED DESCRIPTION OF THE DRAWING

Figure 1:
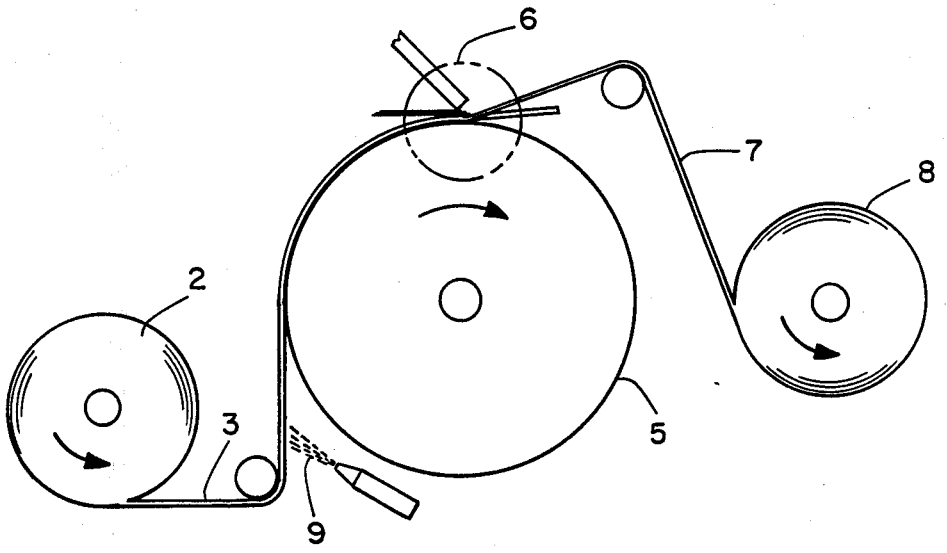
FIG. 1 is a schematic representation of the microcreping process, illustrating the setting in which the process of this invention operates.

Directing attention to FIG. 1, the invention will be described in greater detail. Shown is a simplified overview of the microcreping process, in which the web material to be treated is provided by supply roll 2. The web 3 is unwound from the supply roll and frictionally engaged by the surface of rotating drum roll 5. The drum roll carries the web into the treatment zone 6 designated by the phantom lines and illustrated in more detail in FIG. 2. Upon leaving the treatment zone, the softened web 7 is directed to a converting operation and can be temporarily wound onto roll 8 to isolate the microcreping process from the downstream operations.

As part of this invention, particularly when processing newsprint to make washroom hand towels, it has been found that cross-machine strength degradation normally encountered during microcreping can be significantly reduced by the prior addition of heat and moisture to the web, raising the temperature of the web above its glass transition temperature. In the case of a cellulosic web, reaching a temperature of about 150° F. is sufficient to produce a positive effect. Preferably steam 9 can be applied to the underside of the web to enhance the effect. By using a heated drum roll and steam, strength degradation can be reduced, for example, from about 43% to about 28%.

Figure 2:
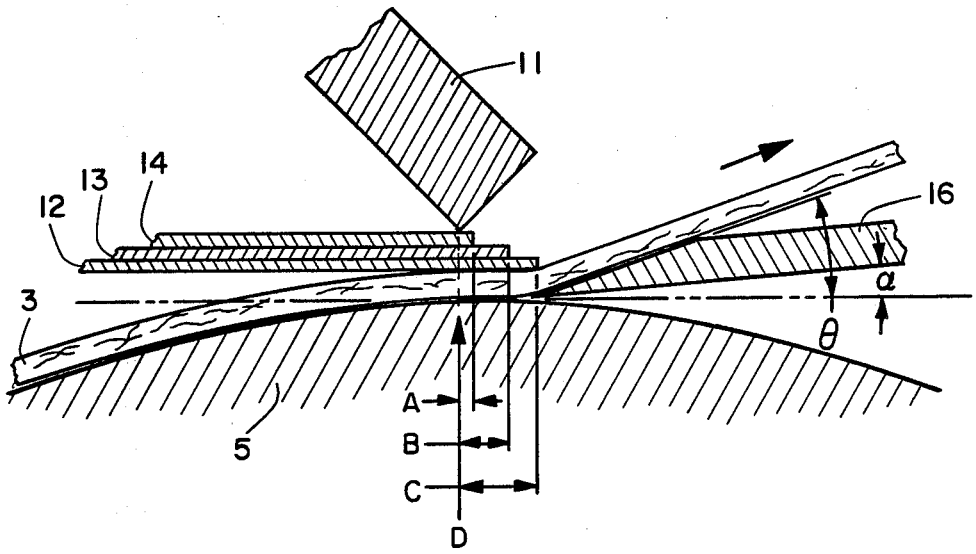
FIG. 2 is an enlarged cross-sectional schematic view of the treatment cavity in which the softening of the web occurs.

FIG. 2 illustrates the geometry of the various elements which comprise the treatment zone or cavity described above. Shown is the rotating drum roll 5, the pressure plate 11, the primary blade 12, a first back-up blade 13, a second back-up blade 14, the rigid retarder blade 16, and the web 3. The top dead center point of the drum roll is designated by arrow "D". The extent to which the ends of the back-up blades and the primary blade are offset from top dead center is designated by letters "A", "B", and "C" as shown. The rigid retarder blade angle is designated as $\alpha$ and the retarder blade operating face angle is designated as $\theta$. Both angles are measured relative to the tangent to the surface of the drum roll at the top dead center point of the drum roll. For purposes herein, the operating face of the retarder blade is that surface which contacts the web. The primary blade is mounted so that it is parallel to the tangent to the drum roll surface at the top dead center point of the drum roll surface.

In operation, the web to be treated is applied to the surface of the rotating drum roll, which surface is of a nature sufficient to frictionally engage the web and carry it through the treatment cavity. Accordingly, it is necessary that the degree of friction between the web and the drum roll be greater than the degree of friction between the web and the primary blade. This requirement is most important for high speed operation and can be augmented by the addition of a lubricant to the top of the web or the underside of the primary blade. Mineral oil, for example, has been found to work well for producing bath tissue. Upon passing under the primary blade, the web becomes compressed in the Z-direction between the primary blade and the drum roll surface. Pressure is applied by the corner edge of the pressure plate and is transmitted to the primary blade through at least two back-up blades positioned in an offset, stepwise configuration. The stepwise configuration provides an operating window in which the pressure transmitted to the web can be more easily controlled by distributing the pressure over a larger surface area. If too little pressure is applied, the web will not be sufficiently softened. If too much pressure is applied, the web will dive under the retarder blade or be choked off and not enter the treatment cavity.

As illustrated in FIG. 2, the distances A, B, and C for this treatment cavity are preferably about 1/32 inch, 4/32 inch, and 7/32 inch, respectively. However, depending upon the basis weight of the web, these dimensions can vary plus or minus about 1/16 inch. The blade thicknesses for the primary blade and back-up blades are about 0.010 inch and the blades are made of spring steel. Preferably the blades are as rigid as possible. As the rigidity increases, the extent to which the ends are offset decreases.

As the web passes under the end of the primary blade, it contacts the operating face of the retarder blade, which causes the web to become compressed lengthwise, since the web cannot expand in the Z-direction due to the constraining forces provided by the primary blade surface. The resulting forces act to soften the web due to micro-fold formation and debonding. Surprisingly, a high degree of softness is obtained with very low operating face angles, which can be in the range of 5° to 15°. Preferably, the operating face angle is from about 7° to about 13°, and most preferably about 10°. The retarder blade angle will correspondingly vary depending upon the angle at which the operating face was ground into the retarder blade.

Figure 3:
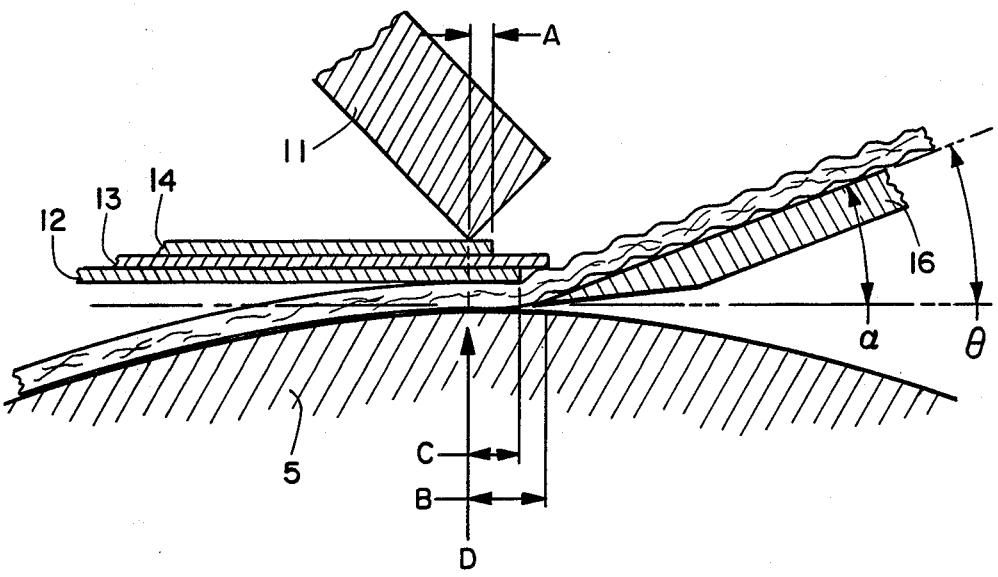
FIG. 3 is a cross-sectional view similar to FIG. 2, illustrating a preferred treatment cavity for making bath tissue.

FIG. 3 illustrates a different treatment cavity in which the primary blade is overlapped by the lowermost back-up blade. The razor edge of the retarder blade is positioned below the portion of the back-up blade which overlaps the primary blade. This treatment cavity provides a web compression zone between the primary blade and the drum roll surface and an expanded web folding zone between the overlapping back-up blade and the drum roll surface. With this treatment cavity geometry, the retarder blade operating face angle is not as important in achieving high speed operation. In the embodiment shown, the retarder blade angle and the operating face angle are the same since the retarder blade is flipped over relative to that shown in FIG. 2.

In practicing the process of this invention, it has been found essential that the tip of the retarder blade have a razor edge which is free from nicks, burrs or other irregularities. Without such a sharp and smooth edge, the web is likely to be torn and/or dive between the retarder blade and the drum roll surface. For purposes herein, a "razor edge" means an edge having a thickness of 0.003 iinch or less, preferably about 0.002 inch or less, and most preferably about 0.001 inch or less, said edge being formed between the two retarder blade surfaces, both of which surfaces have a finish of 63 microinches r.m.s. (root mean square) or less, preferably about 16 microinches or less, and most preferably about 8 microinches or less. A specific retarder blade found useful for purposes of this invention has a razor edge thickness of about 0.00087 in. plus or minus about 0.00024 in.

The retarder blade is preferably formed from blue tempered and polished spring steel, SAE (AISI) 1075 or SAE (AISI) 1095, having a thickness of from about 0.04 to about 0.06 inches thick and having a finish of about 8 microinches. The hardness of the spring steel is preferably from about 48 to about 51 Rockwell "C". At least one surface at the end of the retarder blade leading to the razor edge is ground to a desired bevel, the bevel typically being in the range of from about b 5 to about 20 degrees relative to the plane of the retarder blade. Preferably, one surface of the retarder blade is ground to a bevel of about 10 degrees, the bevelled surface being positioned facing the drum roll as illustrated in FIG. 3. However, other blade materials and blade geometries can be used to form the retarder blade as long as the retarder blade has a razor edge.

As previously mentioned, another critical aspect of this invention is the position of the razor edge of the retarder blade relative to the end of the primary blade. The razor edge must be either directly below the end of the primary blade or the overlapping back-up blade, whichever extends outwardly(downstream) the furthest, or slightly overlapped thereby. In the case where the primary blade is overlapped by a back-up blade, the edge of the retarder blade should be positioned somewhere between the end of the back-up blade and the end of the primary blade. In all cases, it is preferred that the edge of the retarder blade is overlapped by about 1/32 inch. The degree of overlap will depend on a number of factors, including the treatment cavity geometry and the characteristics of the web being treated. However, if the overlap is too great, then diving of the web may occur. If the razor edge is positioned downstream of the end of the blade extending outwardly the furthest, i.e. no overlap, then no folding of the web is achieved. Therefore during start-up, the retarder blade is very gradually moved toward and below the primary blade or the back-up blade, whichever extends downstream the furthest, until the desired results are achieved.

It will be appreciated that the foregoing description, provided for purposes of illustration, is not to be construed as limiting the scope of this invention, which is defined by the following claims.

We claim:

1. In a continuous process for softening a web wherein the web is supported on the surface of a rotating drum and lengthwise compressed in a treatment cavity defined by the surfaces of the rotating drum, a rigid primary blade which presses the web against the rotating drum, and an inclined rigid retarder blade having an operating face angle in the range of 5° to 15° and which is positioned on the side of the web not facing the primary blade and which retards the forward movement of the web and dislodges the web from the surface of the rotating drum, the improvement comprising dislodging the web from the rotating drum with a retarder blade having a razor edge wherein the edge of the retarder blade is directly below or overlapped by the end of the rigid primary blade and wherein the operating face of the retarder blade is an uninterrupted surface.

2. The process of claim 1 wherein pressure is indirectly transmitted to the primary blade from a corner edge of a pressure plate through at least two back-up blades, the ends of which are offset from the end of the primary blade and each other in a stepwise configuration.

3. The process of claim 2 having a first back-up blade and a second back-up blade, wherein the end of the first back-up blade is offset from the end of the primary blade about 3/32 inch.

4. The process of claim 3 wherein the end of the second back-up blade is offset from the end of the first back-up blade about 3/32 inch 5. The process of claim 4 wherein the corner of the pressure plate is offset from the end of the second back-up blade about 1/32 inch.

6. The process of claim 1 wherein the primary blade overlaps the razor edge of the retarder blade about 1/32 inch.

7. The process of claim 1 wherein the web is sprayed with steam prior to entering the treatment cavity.

8. A continuous process for softening a web comprising: (a) supporting the web on the surface of a rotating drum; (b) lengthwise compressing the web in a treatment cavity defined by the surfaces of the rotating drum, a rigid primary blade which is backed by an overlapping back-up blade, and an inclined rigid retarder blade having a razor edge and an operating face positioned on the side of the web not facing the primary blade; and (c) dislodging the web from the surface of the rotating drum by contact with the operating face of the retarder blade, wherein the edge of the retarder blade is positioned below the portion of the back-up blade which overlaps the end of the primary blade.

9. The process of claim 8 wherein a lubricant is applied to the web or the primary blade surface to reduce the friction therebetween.

10. The process of claim 9 wherein the lubricant is mineral oil.

11. The process of claim 9 wherein the lubricant is a silicone compound.

12. The process of claim 8 wherein the web is a single-ply web.

13. The process of claim 8 wherein the web is a two-ply web.

14. The process of claim 8 wherein the retarder blade has an edge thickness of about 0.002 inch or less.

15. The process of claim 8 wherein the retarder blade has an edge thickness of about 0.001 inch or less.

* * * * *